US007878799B2

(12) United States Patent
Flohr et al.

(10) Patent No.: US 7,878,799 B2
(45) Date of Patent: Feb. 1, 2011

(54) MULTIPLE BURNER ARRANGEMENT FOR OPERATING A COMBUSTION CHAMBER, AND METHOD FOR OPERATING THE MULTIPLE BURNER ARRANGEMENT

(75) Inventors: Peter Flohr, Turgi (CH); Christian Joerg Motz, Baden-Daettwil (CH); Majed Toqan, Abu Dhabi (AE); Martin Zajadatz, Kuessaberg/Dangstetten (DE)

(73) Assignee: Alstom Technology Ltd, Baden (CH)

( * ) Notice: Subject to any disclaimer, the term of this patent is extended or adjusted under 35 U.S.C. 154(b) by 81 days.

(21) Appl. No.: 11/529,625

(22) Filed: Sep. 29, 2006

(65) Prior Publication Data

US 2007/0105061 A1 May 10, 2007

Related U.S. Application Data

(63) Continuation of application No. PCT/EP2005/051410, filed on Mar. 29, 2005.

(30) Foreign Application Priority Data

Mar. 31, 2004 (CH) ..... 0559/04

(51) Int. Cl.
*F23D 14/46* (2006.01)

(52) U.S. Cl. ..... 431/351; 431/352; 431/354; 431/350

(58) Field of Classification Search ..... 431/351, 431/352, 354, 350; 60/737, 738, 748
See application file for complete search history.

(56) References Cited

U.S. PATENT DOCUMENTS

| | | | | |
|---|---|---|---|---|
| 5,303,542 | A * | 4/1994 | Hoffa | 60/773 |
| 6,293,105 | B1 | 9/2001 | Claesson et al. | |
| 6,370,863 | B2 * | 4/2002 | Muller et al. | 60/776 |
| 2002/0142257 | A1 | 10/2002 | Eroglu et al. | |
| 2003/0041588 | A1 | 3/2003 | Joos et al. | |
| 2003/0152880 | A1 * | 8/2003 | Eroglu et al. | 431/8 |

FOREIGN PATENT DOCUMENTS

| | | | |
|---|---|---|---|
| DE | 196 52 899 | A1 | 6/1998 |
| DE | 101 08 560 | A1 | 9/2002 |
| EP | 0 387 532 | B1 | 2/1990 |
| EP | 0 597 138 | A1 | 11/1992 |
| EP | 1 077 349 | A1 | 2/2001 |
| EP | 1 331 448 | A2 | 7/2003 |

* cited by examiner

*Primary Examiner*—Alfred Basichas
(74) *Attorney, Agent, or Firm*—Buchanan Ingersoll & Rooney PC

(57) ABSTRACT

What are described are a multiple burner arrangement and a method for operating such a multiple burner arrangement with a multiplicity of individual burners which are designed as premix burners and which serve for firing a combustion chamber of a thermal engine and each have a swirl space into which combustion supply air and fuel can be introduced so as to form a swirl flow, the swirl flow forming downstream of the premix burner, within the combustion chamber, a backflow zone in which a burner flame is formed.

14 Claims, 4 Drawing Sheets

MULTIPLE BURNER ARRANGEMENT FOR OPERATING A COMBUSTION CHAMBER, AND METHOD FOR OPERATING THE MULTIPLE BURNER ARRANGEMENT

RELATED APPLICATIONS

This application is based on and claims priority under 35 U.S.C. §119 to Swiss Application No. 00559/04 filed Mar. 31, 2004 and is a continuation application under 35 U.S.C. §120 of International Application No. PCT/EP2005/051410, filed Mar. 29, 2005 designating the U.S., the entire contents of both of which are hereby incorporated by reference.

BACKGROUND

A multiple burner arrangement is disclosed with a multiplicity of individual burners which are designed as premix burners and which serve for firing a combustion chamber for a thermal engine, preferably for a gas turbine plant, and each have a swirl space into which combustion supply air and fuel are fed so as to form a swirl flow, the swirl flow forming downstream of the premix burner, within the combustion chamber, a backflow zone which forms spatially in a largely stable manner and in which a burner flame is formed after the ignition of the fuel/air mixture. A method for operating a multiple burner arrangement of this type is likewise described.

Multiple burner arrangements have gained acceptance not least because of ecological factors, since the formation of nitrogen oxides in the exhaust gases can be kept low on account of a low flame temperature along with a high air excess. In this connection, in particular, it has become possible for annular combustion chambers, as they are known, to become established, which are employed for the purpose of driving gas turbine plants and provide a multiplicity of individual premix burners in a circular arrangement around the rotating components of a gas turbine, the hot gases of which are supplied directly to the following turbine stage via an annularly designed flow duct.

An annular combustion chamber arrangement of this type may be gathered, for example, from EP 597 138 B1, which provides a multiplicity of annularly arranged premix burners, such as may be gathered, for example, from EP 387 532 A1, these being designed in each case as double cone burners which provide a swirl space surrounded radially by two hollow conical part bodies, the respective center axes of which are arranged so as to be offset relative to one another, so that adjacent walls of two conical part bodies enclose in their longitudinal extent tangential slots for the combustion air. Via a fuel nozzle arranged largely centrally within the swirl space, liquid fuel can be fed into the axially conically widening swirl space. Likewise, the premix burner can be supplied with gaseous fuel via gas inflow ports distributed along the tangential slots within the wall of the two conical part bodies. Mixture formation with the combustion supply air thus already takes place in zones of the inlet slots, as homogeneous a fuel concentration as possible over the entire cross section of the swirl space occurring along the swirl flow propagating axially within the swirl space. This gives rise at the burner outlet to a defined backflow zone which is in the form of a spherical cap and at the tip of which ignition takes place so as to form a burner flame spatially stable within the zone.

During the operation of a gas turbine plant of this type, as a rule, during the starting of the gas turbine and in low load ranges, the fuel supply for each individual premix burner is carried out via what is known as a pilot stage which, depending on the design of the premix burner, is designed as a central burner lance, such as is described, for example, in DE 196 52 899 A1, or as a pilot gas supply provided directly at the burner outlet, upstream of the combustion chamber in the flow direction.

In both instances, fuel is administered directly into the flow zone required for flame stabilization, but, in terms of pollutant emission, burns in an extremely unfavorable mixture ratio under virtually stoichiometric conditions. On account of the $NO_2$, CO and $NO_x$ emission values which are high in what are known as pilot operation, it is therefore necessary, particularly in the medium and upper load range of the gas turbine plant, to throttle the fuel supply via the respective pilot stage and to carry out the supply of fuel within the framework of the premix stage, as it is known, that is to say the feed of gaseous fuel along the air inlet slots through the wall of the conical part shells. After a complete shutdown of the pilot fuel supply, it is necessary to remove combustible residues from the pilot supply lines in order to avoid flame flashbacks into the pilot stage. Technically complicated scavenging methods are required for this purpose. Moreover, the changeover actions from pilot operation to premix operation, or vice versa, are undesirable, since these excite burner-internal pulsations which, depending on their markedness, subject the plant components involved in the combustion process to high mechanical load.

Furthermore, thermoacoustic oscillations of this type preferentially also arise in premix operation, that is to say in the medium and upper load range, due to which the flame stability forming within the combustion chamber is seriously impaired.

Normally, in gas turbines fired by means of annular combustion chambers, all the premix burners are supplied with gaseous fuel in the same way during premix operation. It is shown, however, that, under different load conditions of the gas turbine plant, operating ranges occur in which high combustion chamber pulsations, a poor burn-out and associated high carbon oxide values and also high values of unsaturated hydrocarbons arise and in which a poor transverse ignition behavior of the individual premix burners can be observed.

In order to counteract these problems, DE 101 08 560 A1 proposes deliberately to break up the hitherto adopted symmetry in the fuel supply of all the premix burners provided in the multiple burner arrangement, in order effectively to reduce the occurrence of combustion chamber pulsations. In this case, at least one premix burner is operated in such a way that the at least one premix burner has, within the fuel/air mixture, a spatial mixed profile deviating from all the other premix burners provided in the multiple burner arrangement. In this case, the at least one premix burner provides a fuel feed for the gaseous fuel, deviating structurally from all the other premix burners, along the conical part shells radially delimiting the conical swirl space. Although this measure contributes to the damping of pulsations in the upper load range of the gas turbine plant which are usually in resonant form and rotate circularly in an annular combustion chamber, nonetheless limits are placed on further influence on the burner behavior in terms of the operation of the gas turbine plant in different load states and taking into account other parameters influencing the combustion processes within the respective premix burners, such as, for example, highly varying moisture fractions in the combustion supply air in the case of an increase in power output of the gas turbine, ambient temperature, change in fuel composition and also aging phenomena of the overall gas turbine plant. Moreover, the proposal described above does not allow any subsequent retrofittability on already existing gas turbine plants, and therefore the known measure can be implemented solely in gas turbine plants to be newly procured.

DESCRIPTION OF THE INVENTION

The object on which the invention is based is to develop a multiple burner arrangement with a multiplicity of individual burners designed as premix burners, in particular for operating a gas turbine plant, according to the preamble of claim 1, in such a way that the operation of a multiplicity of individual premix burners can be optimized as flexibly or variably as possible as a function of the respective load state and of the parameters influencing the combustion process, as mentioned above. In particular, it is expedient to provide a regulating possibility which optimizes the operation of a multiple burner arrangement in terms of pollutant emission and which markedly reduces the pulsations caused by combustion over the entire load range.

The solution for achieving the object on which the invention is based is specified in claim 1. The subject of claim 8 is a method for operating a multiple burner arrangement, such as is suitable, for example, for operating an annular combustion chamber.

The multiple burner arrangement according to the invention emphasizes the deliberate use of premix burner systems which can be operated in a staged manner and which have means for internally staged fuel injection into the swirl space for premix operation. For this purpose, each individual premix burner provided in the multiple burner arrangement is supplied with fuel, preferably gaseous fuel, via at least two separate fuel lines, a first and a second fuel line, as they are known, by means of which the fuel is fed into the swirl space for the further formation of the swirl flow. The in each case first fuel line of each premix burner is connected to a first ring line, via which the in each case first fuel lines of all the premix burners within the multiple burner arrangement are supplied with fuel. Furthermore, a second ring line is provided, which is connected in each case to the second fuel line of each individual premix burner provided in the multiple burner arrangement. It is essential, then, that, in the case of a first group of premix burners, the selected number of which is preferably smaller than half the total number provided in the multiple burner arrangement, a regulating unit, for example a throttle valve, influencing the fuel supply is provided in at least one of the fuel lines. By means of a regulated throttling of the fuel supply with respect to a selected group of premix burners, on the one hand, it is possible to provide a deliberately asymmetric temperature profile along an annular premix burner arrangement, for example within the framework of an annular combustion chamber arrangement, and thus effectively to counteract the burner-induced thermoacoustic oscillations, and, on the other hand, the regulatable fuel throttling allows an individual coordination of the burner behavior with basically all the parameters influencing the combustion process.

The burner concept according to the invention with a regulatable fuel throttling at least in the case of deliberately selected premix burners within a multiple burner arrangement can be implemented in premix burners both with a burner lance and with an external pilot supply.

When premix burners with a burner lance at least partially penetrating centrally through the swirl space are used, in starting operation or in the lower load range of the gas turbine a large part of the preferably gaseous fuel is fed into the swirl space via the burner lance. For this purpose, in each case, the burner lances are connected to the in each case first fuel line, these being fed with fuel in each case by a common ring line. By contrast, in the medium and upper load range, the multiple burner arrangement is operated in such a way that markedly more than half the gaseous fuel is supplied, in each case via the second fuel line, to the premix burners via the fuel outlet ports which extend along the air inlet slots. This is made possible by the connection of the fuel supply via the second ring line from which the in each case second fuel lines of the individual premix burners are fed, the fuel feed via the first ring line being throttled, as required. The advantage of this is that, independently of the operating point of the gas turbine plant, an ideal air/fuel mixture can always be generated in which the individual fuel stages are supplied differently with fuel as a function of the load range of the gas turbine plant and an optimum of the combustion behavior in terms of pollutant emissions and pulsation behavior can thereby be achieved, with the result that the operating range of the gas turbine can be extended substantially.

In the same way in which fuel staging is implemented via a burner lance at least partially projecting centrally through the swirl space, it is also possible to carry out fuel staging along the burner air inlet slots. It is also conceivable to implement fuel staging via an externally managed pilot stage which is provided, upstream of the combustion chamber, at the burner outlet.

Independently of the respective embodiment of the premix burners used and of the fuel supply ratio, capable of being set by the load state, between the ring lines and the first and second fuel lines connected to these, the burner concept according to the invention makes it possible, by providing additional regulating units along the fuel lines branching off from a ring line, to have, only in the case of a selected group of premix burners provided in the multiple burner arrangement, a deliberate break-up of symmetry in the temperature distribution along the flame forming within the combustion chamber, with the result that a decisive influence can be exerted on the reduction of thermoacoustic oscillations generated within the combustion chamber. The regulating units, provided in the fuel lines and preferably designed as throttle valves, likewise allow an active regulation or control as a function of parameters influencing the combustion process, such as, for example, the moisture fraction, varying as a function of the load range of the gas turbine arrangement, in the combustion supply air, the ambient temperature, the change in fuel composition and also the aging of gas turbine components.

BRIEF DESCRIPTION OF THE DRAWINGS

The invention is explained below, by way of example, without any restriction of the general idea of the invention, by means of exemplary embodiments, with reference to the drawings in which.

DETAILED DESCRIPTION

Figure 1:
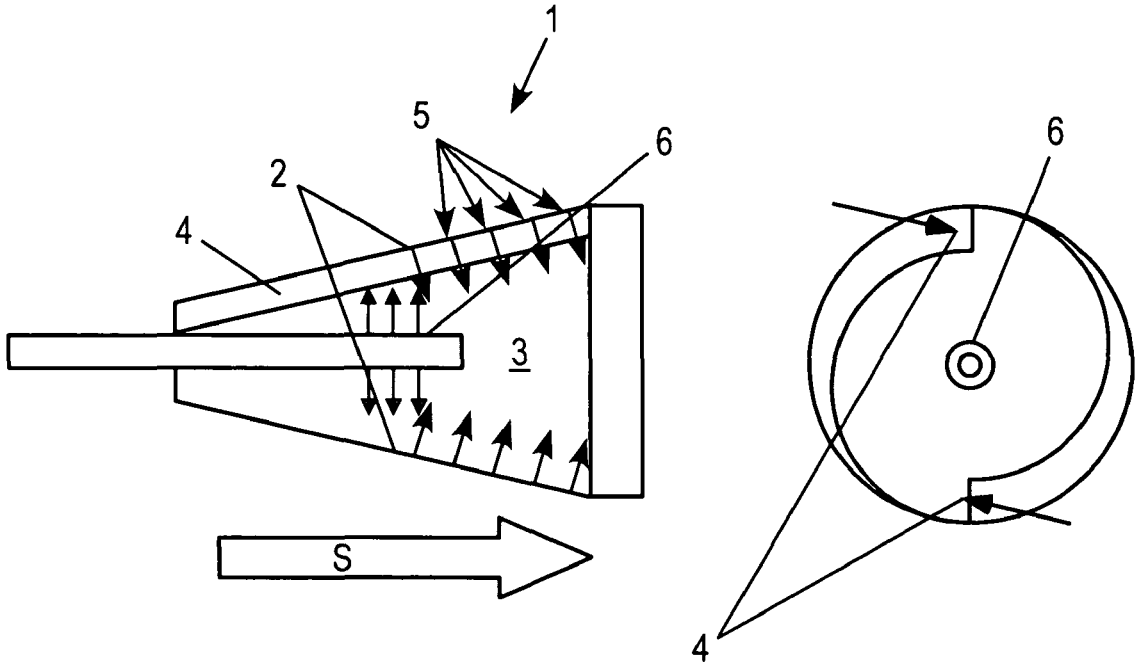
FIG. 1 shows a diagrammatic illustration of an exemplary staged premix burner.

FIG. 1 shows a longitudinal section and a front view, oriented opposite to the flow direction S, of a premix burner 1 with a staged fuel supply. The conically designed premix burner 1 encloses with its highly diagrammatic conical part shells 2, illustrated in FIG. 1, a conically designed swirl space 3. The conical part shells 2, by virtue of their mutually overlapping assembly, enclose in each case air inlet slots 4, along which are arranged, distributed, fuel supply ports 5 through which gaseous fuel is fed into the swirl space 3 so as to form a swirl flow.

Provided so as at least partially to project centrally through the swirl space 3 is a burner lance 6 which likewise has fuel outlet ports through which fuel can be fed into the swirl space 3. The fuel feed takes place via the lance stage 6, preferably during the starting of the gas turbine plant and in the lower load range. By contrast, when the gas turbine is in the medium or upper load range, the fuel feed takes place primarily via the fuel supply ports 5 extending along the conical part shells.

Figure 2A:
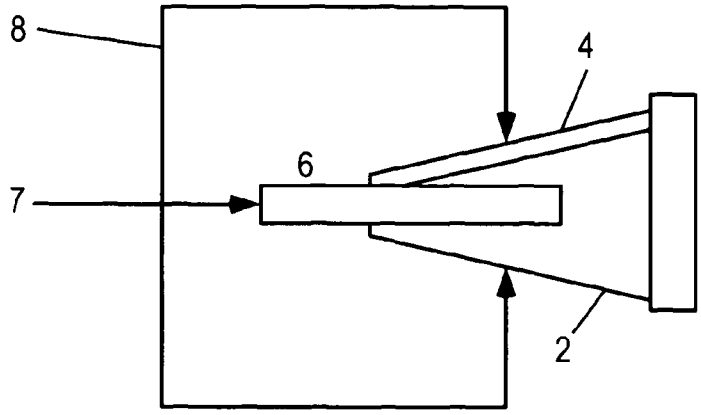
FIG. 2*a-c* show an illustration of alternative fuel lines for the fuel supply of a premix burner, FIG. 3*a,b* show an arrangement of two ring lines for firing a doubly staged premix burner arrangement.

FIG. 2*a* shows diagrammatically the fuel supply on an individual premix burner in the manner of an embodiment illustrated in FIG. 1. A first fuel line 7 is connected to the lance stage 6, whereas a second fuel line 8 is connected to the fuel inlet ports 5 which extend along the air inlet slots 4 within the conical part shells 2.

Figure 2B:
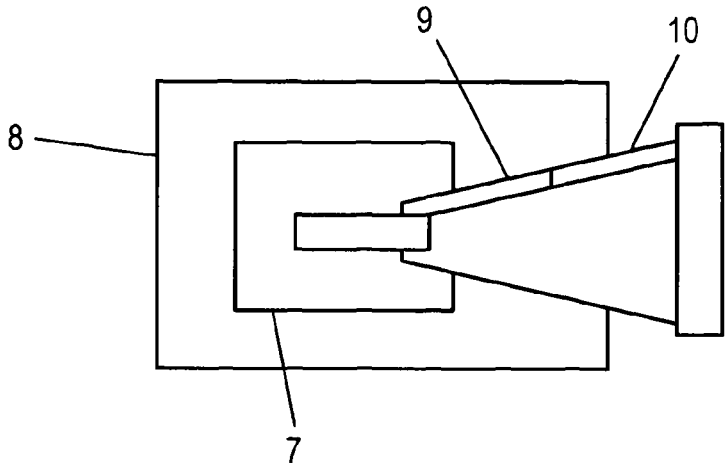

Alternatively to the premix burner variant illustrated above, it is likewise possible to supply a premix burner having a staged design according to the illustration in FIG. 2*b* with fuel separately via the fuel lines 7, 8 along two axially offset fuel feed regions 9, 10.

Figure 2C:
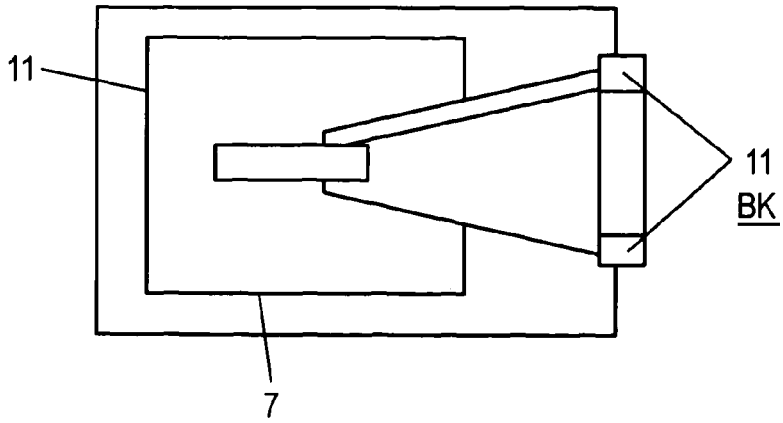

FIG. 2*c* illustrates a further variant of the fuel feed, in which a first fuel stage takes place via an external pilot stage 11 which is provided after the burner outlet and upstream of the combustion chamber BK. The second burner stage corresponds to the fuel feed ports 5, distributed along the air inlet slots 4 in the illustration according to FIG. 2*b,* along the conical part shells 2.

Figure 3:
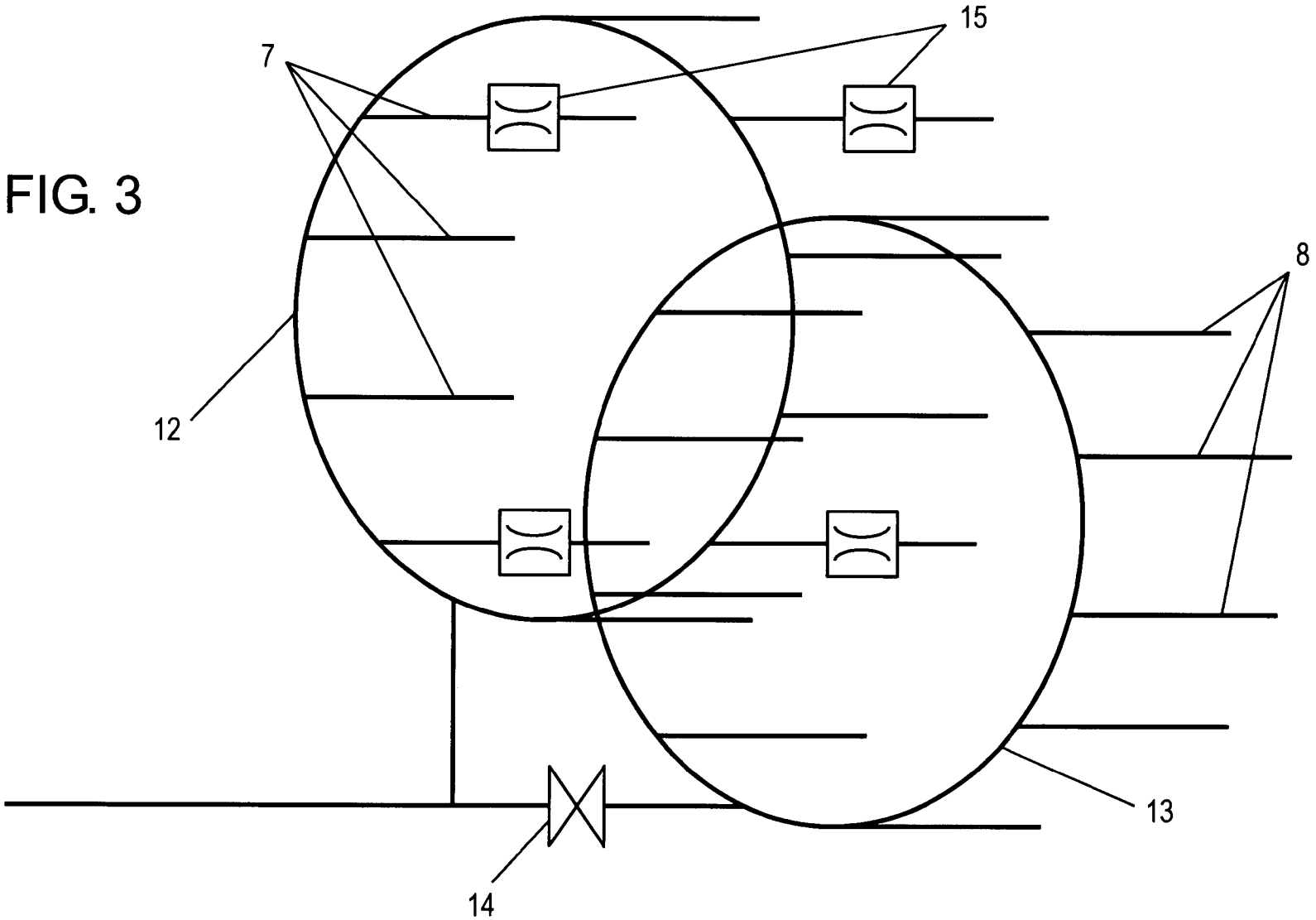

A line plan for the fuel supply of the individual fuel lines 7, 8, by means of which premix burners, not illustrated, are supplied with fuel in the way indicated in FIG. 2, may be gathered diagrammatically from FIG. 3. In this case, the fuel lines 7 of all the premix burners are connected to a first ring line 12 and the fuel lines 8 are connected correspondingly to a second ring line 13. To set a desired fuel supply ratio between the ring lines 12, 13 and therefore also between the fuel lines 7, 8 connected to the ring lines 12, 13, there is at least one regulating device 14, by means of which a fuel allocation capable of being deliberately set can be carried out by the respective ring lines 12, 13. Furthermore, in a specific number of fuel lines 7, here four, additional regulating units 15, preferably regulatable throttle valves, are provided, by means of which a deliberate throttling of the fuel supply via what is in the example in each case the first fuel line 7 preferably connected to the burner lance is possible.

In the exemplary embodiment illustrated in FIG. 3, four of ten premix burners (not illustrated) provided in an annular arrangement are supplied with fuel via the respective fuel lines 7 in a throttled manner as a result of the corresponding throttling of the regulating units 14, with the result that the respective premix burners have a combustion temperature which differs from the combustion temperature of all the other unthrottled premix burners provided in the annular arrangement. As explained initially, this leads to an asymmetry in temperature distribution along the annular premix burner arrangement, with the result that the formation of thermoacoustic oscillations within the combustion chamber can be effectively counteracted. On account of the regulatability of the regulating units 15 designed as throttle valves, it is possible to optimize the combustion process, taking into account the most diverse possible parameters influencing the combustion process.

Figure 4:
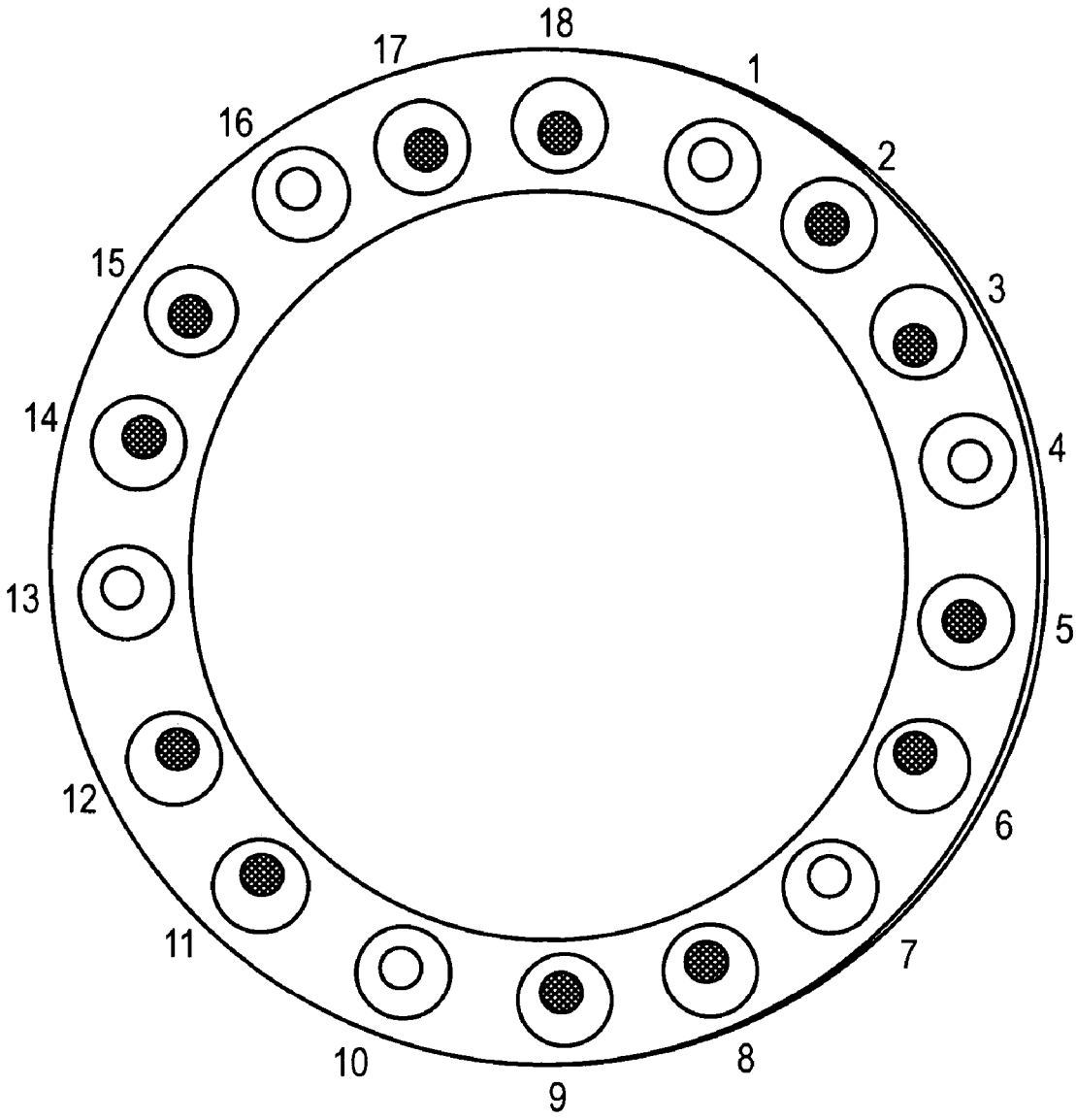
FIG. 4 shows an annular arrangement diagram of premix burners for firing an annular combustion chamber.

A diagrammatic illustration of a multiple burner arrangement for firing an annular combustion chamber is illustrated in FIG. 4. Arranged in an equal distribution on an annular surface are 18 premix burners, of which those premix burners having a black spot are operated, unthrottled, the other ones, in each case being marked by a circle, being operated, throttled, for example with a throttled lance stage. Since, as indicated above, the degree of fuel throttling can be set variably, ultimately for each individual premix burner operated in a throttled manner, different irregular temperature profiles running along the combustion chamber circumference can be set, which make it possible to influence the combustion process decisively. By a regulated influence being exerted on targeted premix burners capable of being operated in a throttled manner in the multiple burner arrangement, the combustion process can be optimized directly when the gas turbine is in operation.

So let it be assumed that the 18 premix burners arranged for firing an annular combustion chamber in FIG. 4 are designed with burner-internal fuel staging with a lance stage and a burner stage. Whereas, in 12 of the burners, both burner stages are opened completely, in the other 6 remaining burners the lance stages are in each case closed completely. In principle, this burner arrangement allows an operating range which is acceptable in terms of pollutant emissions, if 10-50% of the overall fuel supplied to the burners is introduced in each case through the lance stage. It is thereby possible to set the azimuthal burner grouping of the lean burner group, comprising the burners 1, 4, 7, 10, 13, 16, in a range of 16-30% in relation to the overall fuel introduced.

The burner concept according to the invention can be used successfully not only for annular combustion chambers, but also for burner arrangements which provide individual burners distributed uniformly or nonuniformly over a large area, for example for firing a pot-type combustion chamber. It is thus possible, by an appropriate positioning of throttled premix burners, in addition to the already described variant for azimuthal burner grouping, also to set temperature profiles running radially in any desired way. Variants may also be envisaged in which burner arrangements are arranged axially one behind the other, such as, for example, in axially staged combustion chambers.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Premix burner
2 Conical part shell
3 Swirl space
4 Air inlet slot
5 Fuel ports
5 Lance, lance stage
7, 8 Fuel line
9, 10 Fuel feed region
11 External pilot stage
12, 13 First, second ring line
14 Regulating device
15 Regulating unit

The invention claimed is:

1. A multiple burner arrangement with a first ring line, a second ring line, and a multiplicity of individual burners which are designed as premix burners and which serve for firing a combustion chamber of a thermal engine and each have a swirl space into which combustion supply air and fuel can be introduced so as to form a swirl flow, the swirl flow forming downstream of the premix burner, within the combustion chamber, a backflow zone in which a burner flame is formed, wherein each premix burner includes first and second fuel lines configured to feed fuel into the swirl space so as to form the swirl flow, wherein in each case the first fuel line of each premix burner receives fuel from the first ring line and the second fuel line of each premix burner is receives fuel from the second ring line, and wherein, at least in the case of a first group of premix burners, a regulating unit influencing the fuel supply is provided in at least one of the fuel lines.

2. The multiple burner arrangement as claimed in claim 1, the regulating unit is a throttle valve or a diaphragm disk.

3. The multiple burner arrangement as claimed in claim 1, wherein the premix burners each have a swirl space which is designed in the manner of a part cone and which is delimited radially by at least two partially mutually overlapping conical part shells in each case enclosing with another tangential air inlet slots, and wherein the fuel feed directed into the swirl space takes place via at least two separate fuel feed regions which are connected in each case to a fuel line and which are arranged so as to be separated axially from the swirl space designed in the manner of a part cone or so as to partially overlap axially and are in each case connected to a fuel line.

4. The multiple burner arrangement as claimed in claim 3, wherein a burner lance is provided so as at least partially to project centrally into the swirl space axially, and wherein a first fuel feed region is provided along the burner lance and a second fuel feed region is provided along the conical part shells, preferably in the region of the air inlet slots.

5. The multiple burner arrangement as claimed in claim 3, wherein a first fuel feed region is provided along the conical part shells, preferably in the region of the air inlet slots, and a second fuel feed region is provided axially adjacently to the first fuel feed region along the conical part shells.

6. The multiple burner arrangement as claimed in claim 1, wherein the number of premix burners of the first group is smaller than half the total number of the multiplicity of premix burners.

7. The multiple burner arrangement as claimed in claim 1, wherein the multiplicity of premix burners is arranged in the form of a ring arrangement for firing an annular combustion chamber or in the form of a circular surface arrangement for firing a pot-type combustion chamber.

8. The multiple burner arrangement as claimed in claim 1, wherein a regulating device is provided in each case within the first and/or the second ring line.

9. A method for operating a multiple burner arrangement with a first ring line, a second ring line, and a multiplicity of individual burners which serve for firing a combustion chamber of a thermal engine and are designed as premix burners which each have a swirl space into which combustion supply air and fuel are introduced so as to form a swirl flow, the swirl flow forming downstream of the premix burner, within the combustion chamber, a backflow zone in which a burner flame is formed, wherein each premix burner includes first and second fuel lines configured to feed fuel into the swirl space so as to form the swirl flow, the premix burners being subdivided into at least two groups which are in each case supplied with different fuel quantities, the method including supplying the first and second fuel lines of each premix burner with fuel to thereby feed fuel into the swirl space of each premix burner so as to form the swirl flow, in each case the first fuel line of each premix burner being supplied with fuel via the first ring line and the second fuel line of each premix burner being supplied with fuel via the second ring line, and wherein, at least in the case of a first group of premix burners, the fuel supply takes place, throttled, along at least one of the fuel lines.

10. The method as claimed in claim 9, wherein throttling of the fuel supply is carried out in a regulated or controlled manner.

11. The method as claimed in claim 10, wherein the regulation or control of the fuel throttling is carried out as a function of the load state of the thermal engine, on the basis of the reduction of pulsations forming within the combustion chamber, of a reduction in pollutant emission values occurring during combustion and/or as a function of the fuel composition, the ambient temperature and/or the ambient moisture.

12. The method as claimed in claim 9, wherein the fuel feed takes place via at least two axially separated fuel feed regions along the swirl space of each premix burner.

13. The method as claimed in claim 12, wherein a first fuel feed is carried out via a burner lance provided centrally within the swirl space and a second fuel feed is carried out along conical part shells radially delimiting the swirl space.

14. The method as claimed in claim 12, wherein a first and a second fuel feed are carried out along conical part shells radially delimiting the swirl space.

* * * * *